US006516697B2

(12) United States Patent
Cardenas

(10) Patent No.: US 6,516,697 B2
(45) Date of Patent: Feb. 11, 2003

(54) SHOOTING STORAGE STAND AND RELOADING HOPPER

(76) Inventor: John Cardenas, 339 W. Norman Ave., Arcadia, CA (US) 91007

( * ) Notice: Subject to any disclaimer, the term of this patent is extended or adjusted under 35 U.S.C. 154(b) by 5 days.

(21) Appl. No.: 09/844,143

(22) Filed: Apr. 26, 2001

(65) Prior Publication Data

US 2002/0157525 A1 Oct. 31, 2002

(51) Int. Cl.[7] ..... F42B 33/00
(52) U.S. Cl. ..... 86/46; 86/45
(58) Field of Search ..... 86/46, 45; 222/526, 222/528, 531, 532, 538, 539, 540, 564, 153.01, 161, 179.5, 185.1, 425, 460, 461

(56) References Cited

U.S. PATENT DOCUMENTS 1,698,955 A * 1/1929 Lutfring ..... 221/205
3,853,517 A * 12/1974 Mitchell ..... 15/352
4,283,000 A * 8/1981 White ..... 221/312 R
4,454,895 A * 6/1984 Heisler ..... 140/93 B
4,756,046 A * 7/1988 Surface et al. ..... 15/257.06
4,759,148 A * 7/1988 Love ..... 43/54.1
5,186,329 A * 2/1993 Fogelberg ..... 206/372
5,429,265 A * 7/1995 Maire et al. ..... 206/372
5,445,289 A * 8/1995 Owen ..... 222/105
5,797,491 A * 8/1998 Fierek et al. ..... 206/373
5,816,549 A * 10/1998 Anderson ..... 248/213.2
6,085,902 A * 7/2000 Fang ..... 206/373
6,360,891 B1 * 3/2002 Rideout ..... 206/373

* cited by examiner

*Primary Examiner*—Charles T. Jordan
*Assistant Examiner*—Bret Hayes
(74) *Attorney, Agent, or Firm*—Curtis L. Harrington

(57) ABSTRACT

An improved spent shell carriage container, storage and dispensing hopper system provides two structures which can be added to a standard sized bucket, one structure through direct mounting and the other through drop insertion, to produce a spent shell carriage container and dispensing hopper. The direct mounting structure is simply a latch to hold a lower portion of the drop in structure in the closed position. The drop in structure includes a first member which can be shaped to gather support from the inside of the bucket to provide an angled approach to a second member acting as a door. The second member is sized as a partial cup to prevent, limit and stabilize the spent shells appearing and passing through the opening so that a hand sized accumulation will be available for quick manual engagement and loading on the reloading equipment. The door is surrounded on two sides with generally perpendicular walls, and on the end with a fore wall which is back angled with respect to the door at less than a perpendicular angle in order to provide a closer clearance with respect to the opening and to further limit and collect spent shells pouring through the opening.

12 Claims, 3 Drawing Sheets

SHOOTING STORAGE STAND AND RELOADING HOPPER

FIELD OF THE INVENTION

The present invention relates to a convenience structure for dual utilization in the sport of shooting and reloading, and more specifically to a sturdy container and hopper system which can be utilized to collect spent ammunition shells and for sitting, as well as to serve as a stackable reloading hopper, to eliminate waste of space.

BACKGROUND OF THE INVENTION

The prior art structures for collecting spent shells, especially, but not limited to shotgun shells, includes bags, carriage in clothing and the like, and other generally disorganized structures. A particular problem with spent shotgun shells, especially in bulk is the fact that they occupy significant space and are very light. Carriage in clothing can be bulky, even though weight is not a problem, due both to the slight unfolding expansion of the shells upon firing, and the general disorder of the spent shells which cannot be re-ordered into the box.

When clothing compartments are used to retrieve the shells, the volume can test the limits of the clothing. Further, when clothing is used, it typically cannot be removed and set aside either conveniently or as a practical matter. An example of this is the hunting or shooting vest having other pockets and compartments. The ability to, in a stable manner, put aside the empty shells is an advantage which is conventionally not available.

Another problem with spent shells, particularly shotgun shells, is handling during reloading. Where a bag or other container is used, it is required to be significantly underneath the manual extension and grasp of the user to reach in and grasp shells, either one at a time, or by the hand full. Inasmuch as the re-loading process somewhat lends itself to line automation, any repetitive motions need their length and timing to be minimized. A reloader with minimum automation still requires manual placement of the spent shells in a device which will typically initially remove the spent primer. Spent shells need to be made manually available for removal without having to take up an entire area either through spread of the shells within a bag.

What is therefore needed is a device which integrates itself into the shooting and reloading cycle, which provides general utility, can facilitate collection and carriage of spent shells, storage of spent shells, and will assist the reloader in reducing the time and effort spent in manually retrieving the spent shells for reloading. The device should facilitate the leaving of the shells in one place to be left to undertake other action, and should have other utility.

SUMMARY OF THE INVENTION

The improved spent shell carriage container, storage and dispensing hopper system of the present invention provides two structures which can be added to a standard sized bucket, one structure through direct mounting and the other through drop insertion, to produce a spent shell carriage container and dispensing hopper. The direct mounting structure is simply a latch to hold a lower portion of the drop in structure in the closed position. The drop in structure includes a first member which can be shaped to gather support from the inside of the bucket to provide an angled approach to a second member acting as a door. The second member is sized as a partial cup to prevent, limit and stabilize the spent shells appearing and passing through the opening so that a hand sized accumulation will be available for quick manual engagement and loading on the reloading equipment. The door is surrounded on two sides with generally perpendicular walls, and on the end with a wall which is back angled with respect to the door at less than a perpendicular angle in order to provide a closer clearance with respect to the opening and to further limit and collect spent shells pouring through the opening.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
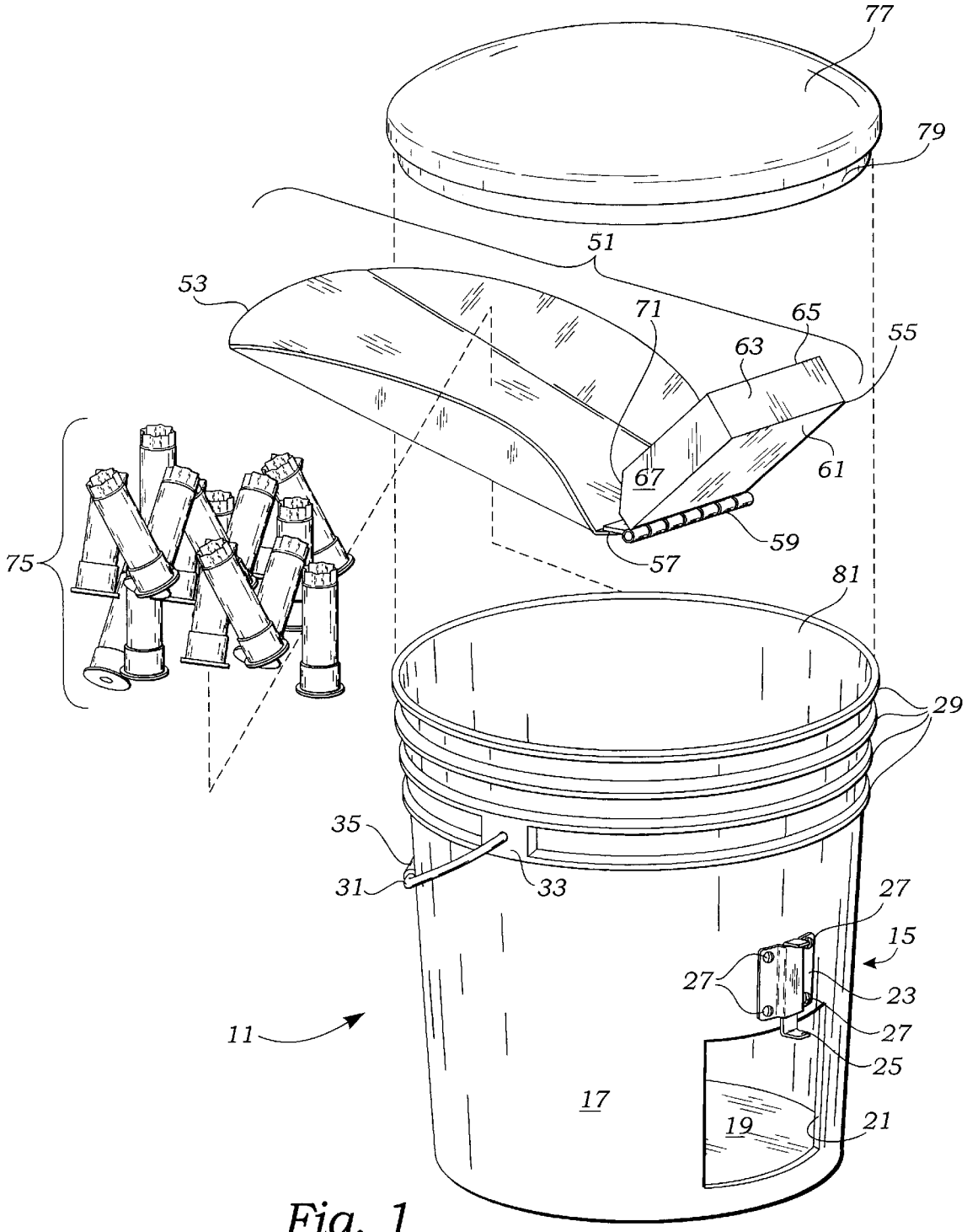
FIG. 1 is a perspective, exploded view of a spent shell carriage container and dispensing hopper bucket with lid lifted and with combined hopper and pivoting door lifted out and shown exploded from spent shells which would normally be supported by it.

A description of the inventive spent shell carriage container, storage and dispensing hopper system of the spent shell carriage container, storage and dispensing hopper of the present invention is shown in FIG. 1 as a system 11. Spent shell carriage container, storage and dispensing hopper system 11 can be obtained as a completed structure or it can be available as a kit for retro-fitting into an existing bucket.

From the bottom, a bucket 15 can be seen has having a continuous cylindrical wall 17 and a flat bottom 19 which can be seen through an opening 21. Above the opening 21 is a plate 23 attached to the wall 17 and having a "U" shaped sliding latch 25 which slides in a space between the wall 17 and bracket 23. The latch 25 slides between a closed position, which is shown in FIG. 1, where the side of the "U" shape nearest the opening 21 slide partially over the opening 21, and an open position where the opening 21 is completely cleared of the side of the "U" shape nearest the opening 21.

The plate 23 is shown as being attached with four threaded screws or bolts 27. Above the straight cylindrical wall 17 is a series of ribs 29 as are typically added to reinforce and make stronger the upper portion of the bucket 15 which otherwise lacks a stabilizing structure such as flat bottom 19 at the other end of the bucket 15. A bail 31 is seen attached to an integral plate 33. Bail 31 has a rolling handle portion 35.

Above the bucket 15 is seen a combined hopper and pivoting door assembly 51. In kit form, the combined hopper and pivoting door assembly 51 will be provided along with plate 23, "U" shaped sliding latch 25, and bolts 27. The combined hopper and pivoting door assembly 51 requires no further assembly or modification. The only modification to the bucket 15 is the formation of the opening 21, and the attachment of the latch mechanism, including the plate 23, "U" shaped sliding latch 25, and bolts 27, in a position to partially overlie the upper portion of the opening.

The combined hopper and pivoting door assembly 51 includes a hopper plate 53 and a box door 55. The hopper plate 53 is provided so that a slanted surface in the direction of the opening 21 is generally provided within the bucket 15. The provision of this surface can be accomplished in several ways. One way is to provide a surface having circular view when looking down from above, but which has a shape to mount within the bucket 15 at an angle, with the periphery of the hopper plate 53 engaging the internal surface of the bucket. This type of support is seen in FIG. 1. Other alternatives can involve a metal stand underneath the hopper plate 53, and other configurations, the sole objective of which is to provide a surface which gravitationally guides toward the opening 21. The hopper plate 53 includes sides which are raised slightly, but this may not required based upon the type of spent shells utilized. For small caliber pistol shells, the workability may vary. In the configuration of FIG. 1, the peripheral contact of the edges of the hopper plate 53, and the partial protrusion of the base of the box door 55 provide good stability.

Other details viewable in FIG. 1 include a narrow connector plate 57 which is one plate of a hinge 59, the other plate of the hinge 59 being attached to the inside surface of a main expanse plate 61 of the box door 55. The box door 55 has a fore wall 63 which is angled to an angle smaller than 90° with respect to main expanse plate 61. The preferable angle will depend upon either or both of the height of the opening as well as the characteristics of the empty shells to be employed within the system 11. The angularity prevents tipping of the spent shells by holding them back at a point above their lowermost extent, and by accommodating to some extent their lower rims. This is especially advantageous for ammunition having its greatest diameter in its rim. Further, for a right angle extent, and especially in cases where the main expanse plate 61 generally matches the size of the opening 21, an upper edge 65 of the fore wall 63 would represent a longer radial distance from the hinge 59, such that opening of the box door 55 would cause the upper edge 65 to "bind" or scrape against the upper part of the opening. The degree of angularity on this basis would increase for shorter height box doors 55 and decrease for taller height box doors 55.

Box door 55 also has a pair of side walls 67 and 69, only side wall 67 being seen in FIG. 1. Side wall 67 is shown with an angled section 71 at what would be a rear corner to accommodate a full vertical position of the box door 55 avoiding interference with either the hopper plate 53 or connector plate 57.

A random appearing group of spent shells 75 is shown as would fit onto the hopper plate 53. A reinforced lid 77 is seen having a circular insertion member 79 to fit within an upper opening 81 of the bucket 15 to make a very stable covering combination which not only resists other than deliberate removal but also has a strength configuration which will support the weight of an individual. In this configuration, the system 11 not only facilitates collection and dispensation of spent shells, or for that matter loaded shells, but also ease of carriage and the provision of a seat. The provision of the seat may be used for hunting, skeet or trap shooting and more. System 11 eliminates the need to carry a separate seat and eliminates the fuss and bother accompanying a folding seat. Once the latch is attached to the bucket 15, the box door is inserted first as the combined hopper and pivoting door assembly 51 is lowered into the opening 81 of the bucket 15. The box door 55 is drawn through the opening 21 as the narrow connector plate 57 is brought to bear upon the bottom of the opening 21, and as the hinge 51 is lifted to slightly clear over the bottom of the opening 21. Once this is done, the box door 55 need only be lifted to vertical position, after the "U" shaped sliding latch 25 has been moved to a position to clear the opening 21. Once the box door 55 and particularly the main expanse plate 61 is vertical, the "U" shaped sliding latch 25 is brought down into a position to prevent opening of the box door 55. The inward angular pivoting of the box door 55 will be limited by interference with either the narrow connector plate 57 or the hopper plate 53, and the size and depth of the angled section 71 can be sized to provided the desired range of motion.

Figure 2:
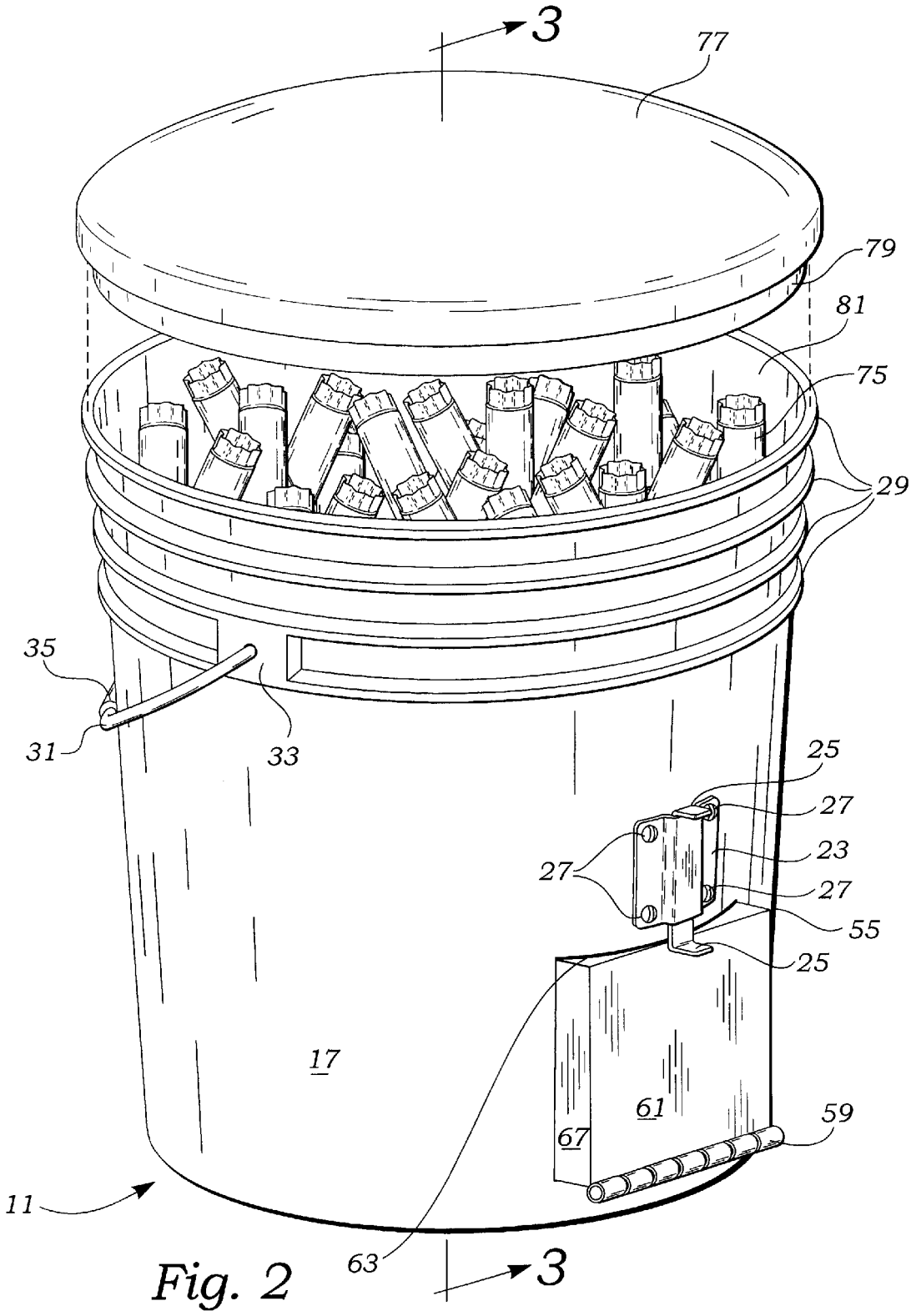
FIG. 2 is a perspective view from the same viewing angle as FIG. 1 but with the component parts assembled, the lid being raised slightly, and the door being engaged by the door latch.

Referring to FIG. 2, a perspective view from the same viewing angle as FIG. 1 shows the system 11 but with the component parts assembled, the lid 77 being raised slightly to illustrate a more full amount of spent shells 75. Further, the "U" shaped sliding latch 25 is shown as having been brought down into a position to prevent the box door 55 from opening. The general configuration of the system 11 is as it would appear after having been used to collect spent shells 75 and with the system 11 ready to dispense spent shells 75.

Figure 3:
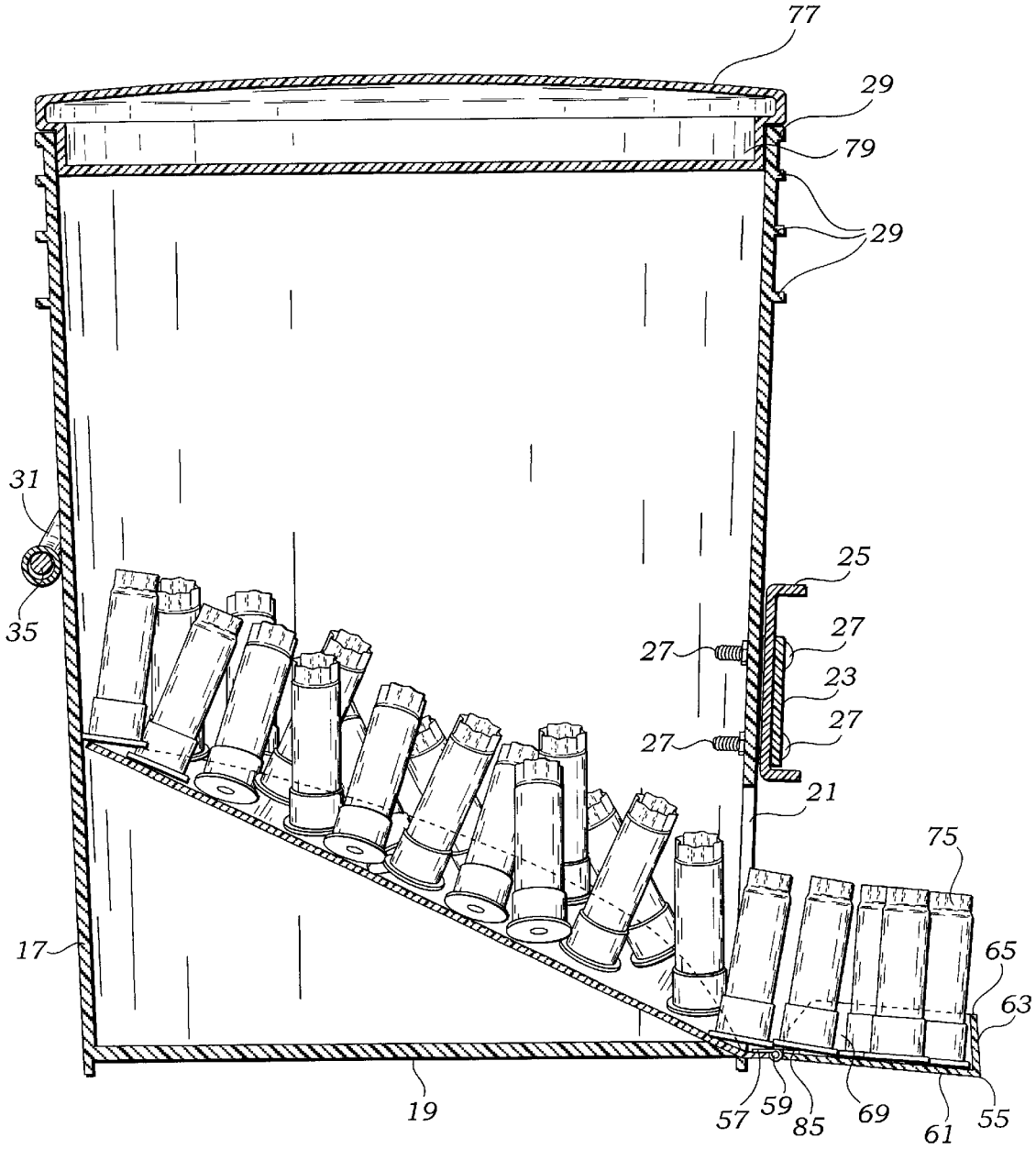
FIG. 3 is a side sectional view illustrating the door in open position and dispensing spent shells onto the open door.

Referring to FIG. 3, a side sectional view illustrating the door in open position and illustrating the plate 57 of the hinge 59 and seen for the first time is plate 85 attached to the back side of main expanse plate 61. As can be seen in the case of spent shells 75 which are shot gun spent shells, they tend to stand up when having reached the inside of the box door 55. Note that the lower rim of the rightmost spent shell 75 is accommodated and that the fore wall 63 supports that spent shell 75 at both its base and at an upper portion by upper edge 65. This "bottom grasping" effect helps the spent shells 75 tend to stand up a bit more than would otherwise be the case. In the "standing" position, they are more easily grasped and more quickly manipulated onto a loader.

While the present invention has been described in terms of a spent shell carriage container, storage and dispensing hopper system, one skilled in the art will realize that the structure and techniques of the present invention can be applied to many similar structures. The present invention may be applied in any situation where materials are to be collected and dispensed and where additional utility is desired.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A spent shell carriage container, storage and dispensing hopper system comprising:

a container having an upper opening and a lower opening;

a combined hopper and pivoting door assembly fittable into said container, and having a hopper portion and a pivoting door portion, said hopper portion for gravitationally directing toward said lower opening and said pivoting door portion for effectively blockingly covering said lower opening; and a latch assembly mounted adjacent at least one of said lower opening and said pivoting door portion for selectively enabling said door portion to fold down to both expose said lower opening and provide a tray for containing an amount of dispensed material.

2. The spent shell carriage container, storage and dispensing hopper system recited in claim 1 wherein said pivoting door portion has a main expanse plate supporting a pair of opposing side walls and a fore wall opposite pivoting connection of said pivoting door portion to said hopper portion.

3. The spent shell carriage container, storage and dispensing hopper system recited in claim 2 wherein said fore wall extends at an acute angle with respect to said main expanse plate.

4. The spent shell carriage container, storage and dispensing hopper system recited in claim 1 wherein said latch assembly is mounted on said container and selectably extends to engage said door portion to prevent its folding down.

5. The spent shell carriage container, storage and dispensing hopper system recited in claim 1 wherein said latch assembly further comprises:

a plate securable to said container; and a shaped sliding latch at least partially supported by said plate for sliding to a first position at least partially blocking said lower opening to prevent pivotal lowering of said door portion and a second position not blocking said lower opening to permit said door portion to achieve an open position with respect to said lower opening.

6. The spent shell carriage container, storage and dispensing hopper system recited in claim 1 wherein said hopper portion has a periphery shaped to engage an internal surface of said container to support said hopper portion at a slanted position toward said lower opening.

7. The spent shell carriage container, storage and dispensing hopper system recited in claim 1 wherein said hopper portion and said pivoting door portion are joined by a hinge.

8. The spent shell carriage container, storage and dispensing hopper system recited in claim 7 wherein said hinge lies outside of said lower opening.

9. The spent shell carriage container, storage and dispensing hopper system recited in claim 1 and further comprising a bale for engaging and facilitating carriage of said container.

10. The spent shell carriage container, storage and dispensing hopper system recited in claim 1 and further comprising a lid fittable at least partially within and covering said upper opening.

11. The spent shell carriage container, storage and dispensing hopper system recited in claim 10 and further comprising a plurality of strengthening ribs encircling said container to facilitate support of said container adjacent said upper opening and for enhancing support of said lid.

12. A kit for creating a spent shell carriage container, storage and dispensing hopper system in combination with a container comprising:

a combined hopper and pivoting door assembly fittable into said container, and having a hopper portion and a pivoting door portion, said hopper portion for gravitationally directing toward a lower opening of said container and said pivoting door portion for effectively blockingly covering said lower opening of said container; and a latch assembly for mounting adjacent at least one of said lower opening of said container and said pivoting door portion for selectively enabling said door portion to fold down to both expose said lower opening and provide a tray for containing an amount of dispensed material, said latch assembly further comprising a plate; and a shaped sliding latch at least partially supported by said plate.

* * * * *